US007344419B2

(12) United States Patent
Sugiyama et al.

(10) Patent No.: US 7,344,419 B2
(45) Date of Patent: Mar. 18, 2008

(54) CONNECTOR

(75) Inventors: Osamu Sugiyama, Makinohara (JP); Yoshihiro Iwahori, Makinohara (JP); Mitsuo Akiyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/753,595

(22) Filed: May 25, 2007

(65) Prior Publication Data

US 2007/0275599 A1 Nov. 29, 2007

(30) Foreign Application Priority Data

May 26, 2006 (JP) ..... 2006-146918

(51) Int. Cl.
*H01R 13/514* (2006.01)

(52) U.S. Cl. ..... 439/752; 439/595

(58) Field of Classification Search ..... 439/595, 439/752

See application file for complete search history.

(56) References Cited

U.S. PATENT DOCUMENTS 6,093,063 A * 7/2000 Tsuji et al. ..... 439/752
6,193,551 B1 * 2/2001 Yamamoto et al. ..... 439/595
6,652,328 B2 * 11/2003 Suzuki ..... 439/752
7,281,961 B1 * 10/2007 Sugiyama et al. ..... 439/752

FOREIGN PATENT DOCUMENTS

JP 2003-45549 A 2/2003
JP 2004-319155 A 11/2004

* cited by examiner

*Primary Examiner*—James Harvey
(74) *Attorney, Agent, or Firm*—Sughrue Mion, PLLC

(57) ABSTRACT

To provide a connector in which a compact design of the connector can be achieved, and besides a retaining force for preventing withdrawal of a metal terminal can be further increased, a connector housing 10 includes terminal receiving chambers 11 into which metal terminals 30 can be inserted, respectively, from a rear side, elastic lances 12 for respectively retaining the metal terminals 30 to prevent rearward withdrawal of the metal terminals 30, an elastic deformation space 13 for the lances, and a front holder insertion space 16 which is provided at a front side of the elastic deformation space in continuous relation thereto such that a front holder can be inserted into a predetermined position in the front holder insertion space from the front side. The front holder 20 has lance holding portions 22 which enter the elastic deformation space to prevent elastic deformation of the lances when the front holder is mounted into the connector housing from the front side, and the lance and the lance holding portion have an engagement convex portion 12*b* and a retaining portion 23, respectively, which can be engaged with each other to prevent forward movement of the front holder and also to transmit a rearward force, applied from the metal terminal to the lance, to the front holder.

2 Claims, 4 Drawing Sheets

CONNECTOR

BACKGROUND OF THE INVENTION

1. Field of the Invention

This invention relates to a connector in which elastic deformation of a lance is prevented by the use of a front holder, thereby increasing a retaining force for preventing withdrawal of a metal terminal.

2. Description of the Related Art

Patent Literature 1 and Patent Literature 2 disclose conventional connectors in which elastic deformation of lances are prevented by the use of a front holder. In this kind of connector, metal terminals are inserted into respective terminal receiving chambers in a connector housing from a rear side thereof, and in this condition the front holder is attached to the connector housing from the front side thereof, so that lance holding portions of the front holder are inserted into an elastic deformation space for the lances, thereby preventing elastic deformation of the lances, thus retaining the metal terminals in a double manner.

In this case, generally, retaining means for preventing withdrawal of the front holder is provided at a place spaced apart from the lances Patent Literature 1: JP-A-2003-45549 Publication Patent Literature 2: JP-A-2004-319155 Publication In the above conventional connector, the retaining means for preventing the withdrawal of the front holder is provided at the place spaced apart from the lances, and therefore an additional space is required, and this has sometimes been an obstacle to a compact design of the connector. And besides, in the above conventional connector, the metal terminals are retained in a double manner by preventing the elastic deformation of the lances by the front holder, and if the retaining force for preventing the withdrawal of the metal terminals is further increased, this is desirable.

SUMMARY OF THE INVENTION

This invention has been made in view of the above circumstances, and an object of the invention is to provide a connector in which means for preventing withdrawal of a front holder is provided at a lance so as to contribute to a compact design of the connector, and also a retaining force for preventing withdrawal of a metal terminal can be increased.

The above object has been achieved by a connector of the present invention having features recited in the following Paragraphs (1) and (2).

(1) A connector characterized in that the connector comprises:

a connector housing; and a front holder attached to the connector housing from a front side thereof; and the connector housing includes a terminal receiving chamber into which a metal terminal can be inserted from a rear side thereof, an elastic lance for retaining the metal terminal, inserted into the terminal receiving chamber from the rear side, to prevent rearward withdrawal of the metal terminal, an elastic deformation space for the lance, and a front holder insertion space which is provided at a front side of the elastic deformation space in continuous relation thereto such that the front holder can be inserted into a predetermined position in the front holder insertion space from the front side of the connector housing; and the front holder has a lance holding portion which enters the elastic deformation space to prevent elastic deformation of the lance when the front holder is mounted into the front holder insertion space of the connector housing from the front side thereof; and an engagement portion is provided between the lance and the lance holding portion, and when the lance and the lance holding portion are engaged with each other, the engagement portion prevents forward movement of the front holder, and also transmits a rearward force, applied from the metal terminal to the lance, to the front holder.

(2) In the connector of the above Paragraph (1), when the lance and the lance holding portion are engaged with each other, the engagement portion provided between the lance and the lance holding portion presses and displaces the lance in a direction to more firmly engage the lance with the metal terminal.

In the connector of the construction of the above Paragraph (1), the withdrawal of the front holder can be prevented directly by the lance. Therefore, retaining means for preventing the withdrawal of the front holder does not need to be provided at other portion of the housing than the lance, and this contributes to a compact design of the connector. And besides, in the connector of the construction of the above Paragraph (1), the front holder assists the lance in retaining the metal terminal against withdrawal, and therefore a force for retaining the metal terminal can be increased. Furthermore, in the connector of the construction of the above Paragraph (1), when the metal terminal is in a half-inserted condition, the lance is kept elastically deformed to be received in the elastic deformation space, and therefore the front holder can not be inserted into the predetermined position. Therefore, the half-inserted condition of the metal terminal can be detected from this. In this case, the lance has the engagement portion for engagement with the front holder, and therefore a surface of the lance for abutting against the front holder can be made large, and therefore an abutting or striking force can be set to a large value, and the performance of detection of such a half-inserted condition of the metal terminal can be enhanced.

In the connector of the construction of the above Paragraph (2) the front holder, when attached to the connector housing, presses and displaces the lance in such a direction as to more firmly engage the lance with the metal terminal, and therefore the force for retaining the metal terminal can be further increased, Furthermore, a clearance between the metal terminal and the lance can be reduced, and therefore the shaking or movement of the metal terminal can be reduced.

In the present invention, there can be provided the connector in which the compact design of the connector can be achieved, and besides the retaining force for preventing the withdrawal of the metal terminal is further increased.

The present invention has been described briefly. Details of the invention will become more manifest upon reading the following Section "Best Node for Carrying Out the Invention" with reference to the accompanying drawings.

BRIEF DESCRIPTION OF THE DRAWINGS

FIG. 1A is a front-elevational view, and FIG. 1B is a cross-sectional view taken along the line Ib-Ib of FIG. 1A.

FIG. 2A is a front-elevational view, and FIG. 2B is a cross-sectional view taken along the line IIb-IIb of FIG. 2A, and FIG. 2C is a bottom view.

FIG. 3A is a front-elevational view, and FIG. 3B is a cross-sectional view taken along the line IIIb-IIIb of FIG. 3A.

FIG. 4A is a front-elevational view, and FIG. 4B is a cross-sectional view taken along the line IVb-IVb of FIG. 4A.

DESCRIPTION OF THE PREFERRED EMBODIMENTS

A preferred embodiment of the present invention will now be described with reference to the drawings.

Figure 1:
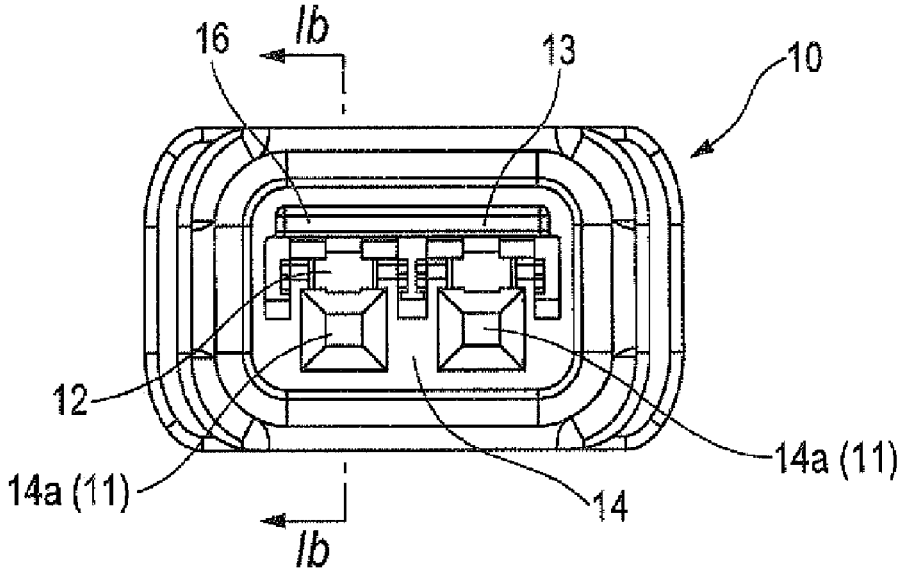
FIGS. 1A and 1B show the construction of a connector housing of a connector embodying the present invention.
Figure 1:
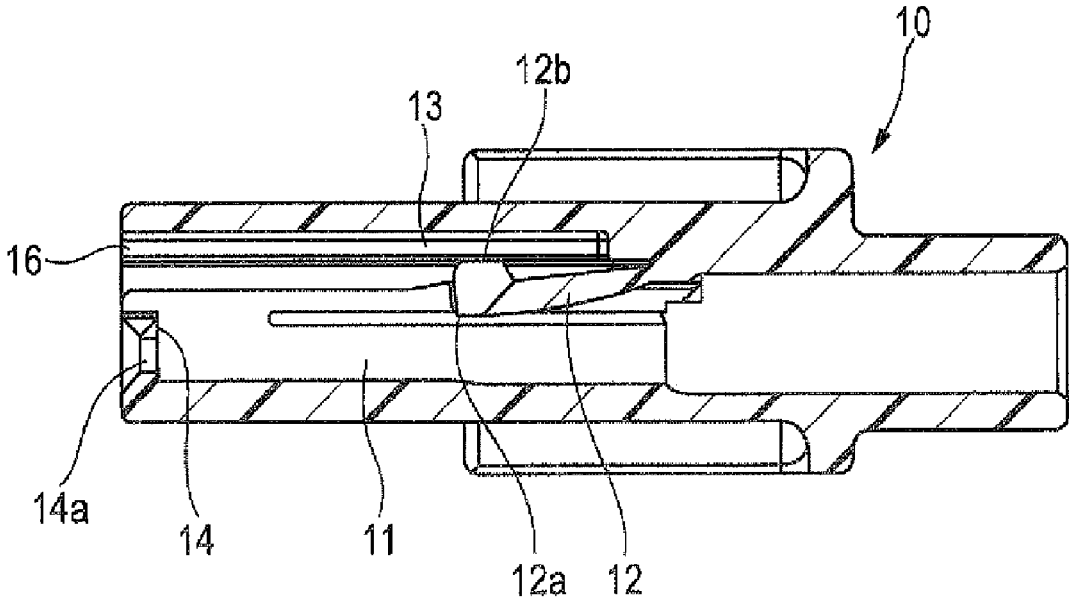
Figure 2:
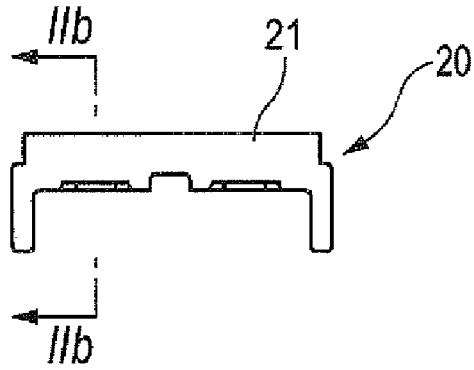
FIGS. 2A, 2B and 2C show the construction of a front holder of the connector of the invention.
Figure 2:
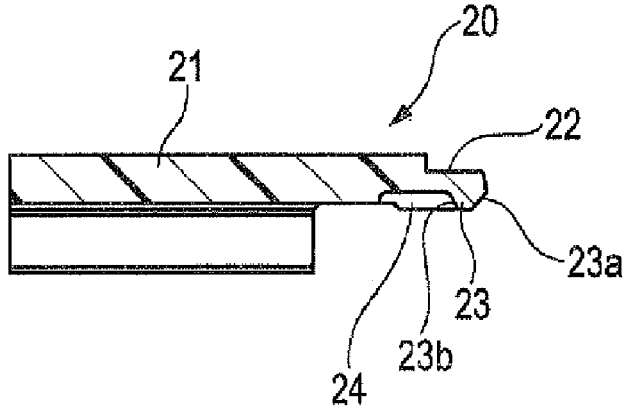
Figure 2:
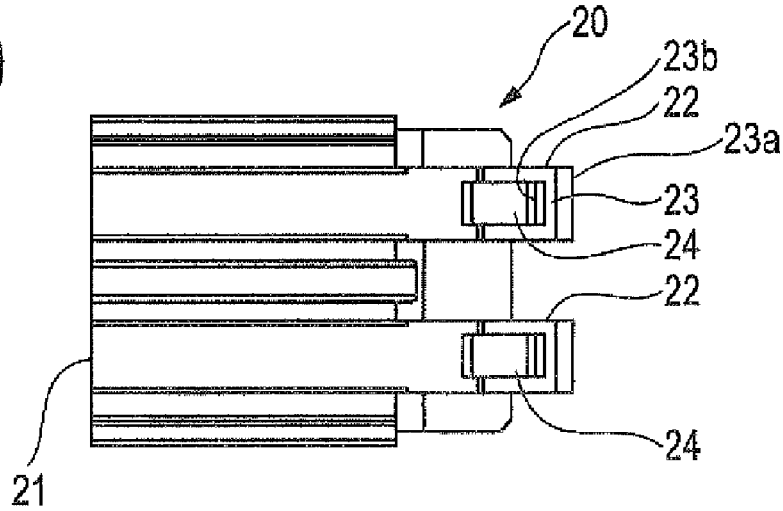
Figure 3:
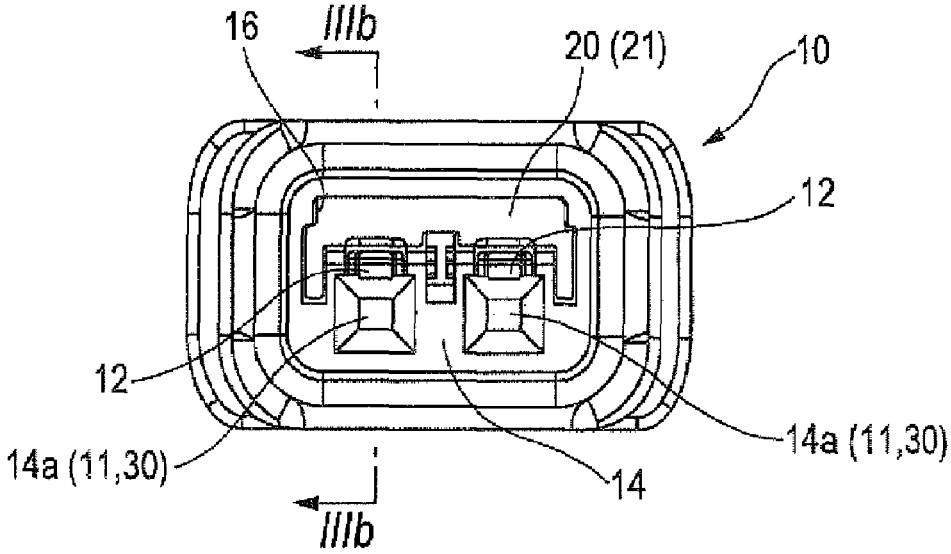
FIGS. 3A and 3B show a condition in which the front holder of FIGS. 2A to 2C is half inserted in the connector housing of FIGS. 1A and 1B from a front side thereof after metal terminals are inserted into the connector housing.
Figure 3:
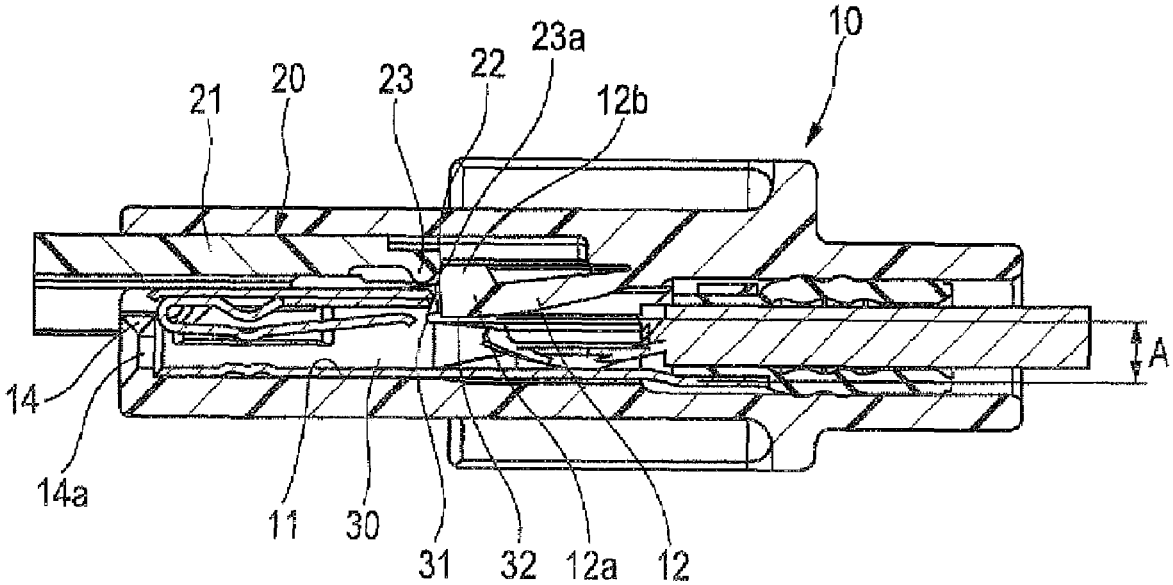
Figure 4:
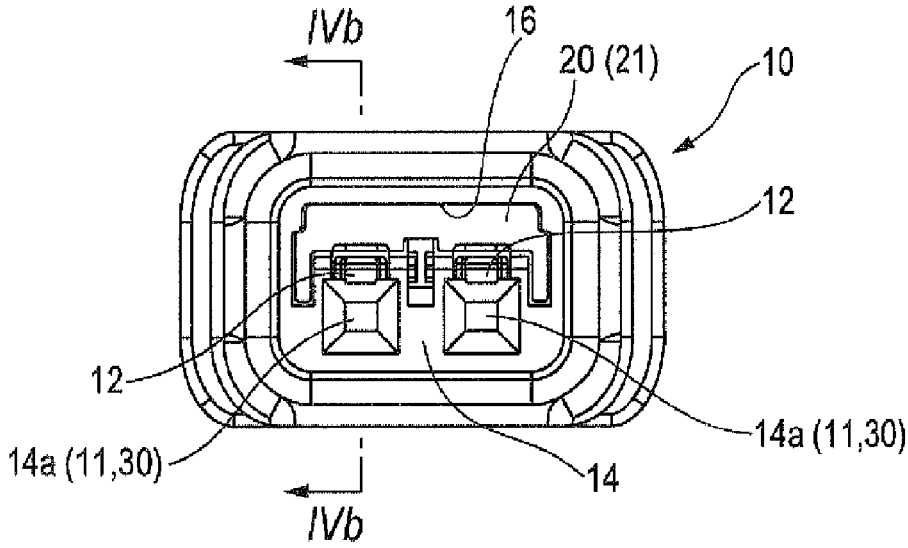
FIGS. 4A and 4B show a condition in which the front holder is completely inserted in the connector housing.
Figure 4:
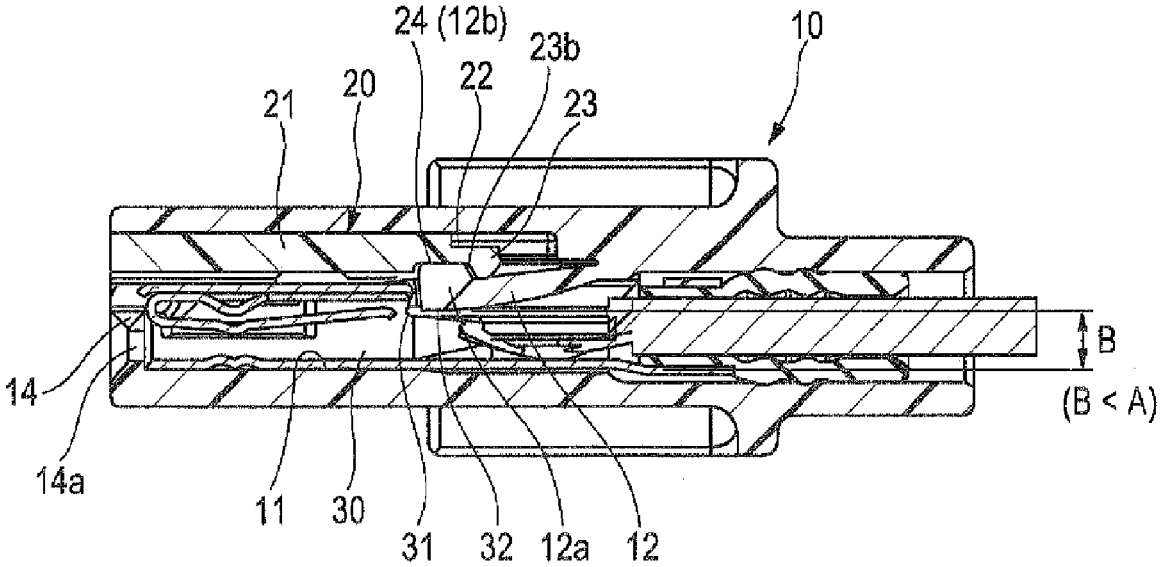

FIGS. 1A and 1B show the construction of a connector housing of a connector embodying the invention, and FIG. 1A is a front-elevational view, and FIG. 1B is a cross-sectional view taken along the line Ib-Ib of FIG. 1A. FIGS. 2A, 2B and 2C show the construction of a front holder of the connector of the invention, and FIG. 2A is a front-elevational view, and FIG. 2B is a cross-sectional view taken along the line IIb-IIb of FIG. 2A, and FIG. 2C is a bottom view. FIGS. 3A and 3B show a condition in which the front holder of FIGS. 2A to 2C is half inserted in the connector housing of FIGS. 1A and 1B from a front side thereof after metal terminals are inserted into the connector housing, and FIG. 3A is a front-elevational view, and FIG. 3B is a cross-sectional view taken along the line IIIb-IIIb of FIG. 3A. FIGS. 4A and 4B show a condition in which the front holder is completely inserted in the connector housing, and FIG. 4A is a front-elevational view, and FIG. 4B is a cross-sectional view taken along the line IVb-IVb of FIG. 4A.

The connector of this embodiment comprises the connector housing 10, the front holder 20 attached to the connector housing 10 from the front side of this connector housing (here, the direction from which a mating connector is fitted to the connector of this embodiment is referred to as "the front side") and the metal terminals 30 inserted and received in the connector housing 10.

The connector housing 10 includes terminal receiving chambers 11 into which the metal terminals 30 can be inserted, respectively, from a rear side, lances 12 (each having elasticity such that it can be elastically deformed in an upward-downward direction in FIG. 1B) for respectively retaining the metal terminals 30, inserted in the respective terminal receiving chambers 11 from the rear side, against rearward withdrawal, an elastic deformation space 13 for the lances 12, and a front holder insertion space 16 which is provided at a front side of the elastic deformation space 13 in continuous relation thereto such that the front holder 20 can be inserted into a predetermined position in the front holder insertion space 16 from the front side of the connector housing.

A front end wall 14 for limiting the insertion of the metal terminals 30 is disposed at front ends of the terminal receiving chambers 11, and insertion ports 14*a* for the insertion of respective terminals of the mating connector thereinto are formed through this front end wall 14.

Each lance 12 is supported at its opposite (front and rear) ends, and has a terminal retaining portion 12*a*. When the lance 12 is not elastically deformed and hence is disposed in its normal position, the terminal retaining portion 12*a* is disposed within the terminal receiving chamber 11, and is engaged with an engagement recess portion 31 of the metal terminal 30, thereby preventing withdrawal of the metal terminal 30. This engagement recess portion 31 does not always need to be provided at the metal terminal 30, and if the metal terminal 30 has a portion for engagement with the terminal retaining portion 12*a* of the lance 12, this is sufficient. The lance 12 further includes a front holder-retaining convex portion (engagement portion) 12*b* for retaining the front holder 20 to prevent forward withdrawal of the front holder 20, the front holder-retaining convex portion 12*b* being disposed above the terminal retaining portion 12*a*. Incidentally, a clearance 32 is secured between the terminal retaining portion 12*a* of the lance 12 and the engagement recess portion 31 of the metal terminal 30, and this clearance 32 allows downward elastic deformation of the lance 12 at the time when the lance 12 is brought into complete engagement with the front holder 20.

The front holder 20 has lance holding portions 22 formed at a front end (directed toward the rear end of the connector housing 10) of a body portion 21 thereof. When the front holder 20 is inserted into the front holder insertion space 16 of the connector housing 10 from the front side, the lance holding portions 22 enter the elastic deformation space 13 for the lances 12 to prevent elastic deformation of the lances 12, Retaining portions 23 are formed respectively at lower surfaces of the lance holding portions 22, and can be engaged respectively with the front holder-retaining convex portions 12*h* of the lances 12 to prevent the forward movement of the front holder 20. When the retaining portion 23 is engaged with the lance 12, this retaining portion 23 also serves to transmit a rearward force, applied from the metal terminal 30 to the lance 12, to the front holder 20.

A recess portion 24 for fitting on the front holder-retaining convex portion 12*b* of the lance 12 is formed just at the rear side of the retaining portion 23, so that the retaining portion 23 has a convex shape. A front end surface 23*a* of the retaining portion 23 facing in the direction of inserting of the front holder 20 is slanting, and also its rear end surface 23*b* is slanting. The front end surface 23*a* as well as the rear end surface 23*b* is slanting in such a direction as to elastically deform the lance 12 downward when the retaining portion 23 strikes against the front holder-retaining convex portion 12*b* of the lance 12. Incidentally, when it is desired to increase the force for retaining the lance 12 and the front holder 20 relative to each other, the rear end surface 23*b* is formed into a vertical surface.

The recess portion 24 disposed just at the rear side of the retaining portion 23 is the portion into which the front holder-retaining convex portion 12*b* of the lance 12 is fitted when the front holder 20 and the lance 12 are engaged with each other. When the front holder-retaining convex portion 12*b* is fitted into the recess portion 24, the lance 12 is elastically deformed into a position lower than its normal position. Namely, the recess portion 24 is so formed as to press the lance 12 to displace it in a direction to engage the lance 12 with the metal terminal 30 more firmly than in a free condition of the lance 12.

Next, the operation will be described.

When each metal terminal 30 fixedly secured to an end portion of a wire is inserted into the terminal receiving chamber 11 from the rear side, the lance 12 is pressed by the metal terminal 30, and is once elastically deformed into the elastic deformation space 13. When the metal terminal 30 is further inserted, the engagement recess portion 31 of the metal terminal 30 reaches the terminal retaining portion 12*a* of the lance 12, and at this stage the lance 12 is restored into its original position, so that the terminal retaining portion 12*a* of the lance 12 becomes engaged in the engagement recess portion 31 of the metal terminal 30. Therefore, when a rearward withdrawing force acts on the metal terminal 30, the lance 12 resists this withdrawing force, so that the metal terminal 30 is prevented from withdrawal.

In this condition, the front holder 20 is inserted into the front holder insertion space 16 of the connector housing 10 from the front side. As a result, the front end of each lance holding portion 22 is brought into abutting engagement with the front end of the front holder-retaining convex portion 12*b* of the corresponding lance 12 as shown in FIG. 3B.

Here, in case each metal terminal 30 has been inserted into the proper position, so that the lance 12 has been restored into the normal position, the front end surface (slanting surface) 23*a* of the retaining portion 23 of the lance holding portion 22 is brought into abutting engagement with the front end surface of the front holder-retaining convex portion 12*b* of the lance 12, and therefore a pressing-down force due to the slanting surface acts on the lance 12, so that the lance 12 is elastically deformed downward. Then, when the front holder 20 is further inserted into the insertion limit, the retaining portion 23 of the convex shape slides over the front holder-retaining convex portion 12*b* of the lance 12, and becomes engaged with this front holder-retaining convex portion 12*b* as shown in FIG. 4B.

Thus, the front holder 20 is retained by the lances 12, and therefore is prevented from withdrawal. At the same time, the elastic deformation of the lances 12 toward the elastic deformation space 13 is prevented by the front holder 20, and therefore each metal terminal 30 is retained in a double manner by the lance 12 and the front holder 20.

In this condition, the front holder-retaining convex portion 12*b* of the lance 12 is fitted in the recess portion 24 of the front holder 20. Therefore, the lance 12 is held in a slightly downwardly-displaced condition. Namely, a dimension of the clearance 32 (indicated by reference character B in FIG. 4B) in the finally assembled condition is smaller than the dimension of the clearance 32 indicated by reference numeral A in FIG. 3B. The lance 20 can be further pressed to be displaced downward into firm contact with the metal terminal 30. By doing so, the shaking or movement of the metal terminal 30 due to vibrations of a vehicle, etc., can be suppressed.

In case the metal terminal 30 is in a half-inserted condition, the lance 12 is kept elastically deformed to be received in the elastic deformation space 13. Therefore, the front end of the holding portion 22 of the front holder 20 is brought into abutting engagement with the front end of the front holder-retaining convex portion 12*b*, so that the front holder 20 can not be inserted into the predetermined position. Therefore, the half-inserted condition of the metal terminal 30 can be detected from this.

In this case, the front holder-retaining convex portion 12*b* is provided at the lance 12, and therefore the surface of the lance 12 for abutting against the front holder 20 can be made large, and therefore the abutting or striking force can be set to a large value, and the performance of detection of a half-inserted condition of the metal terminal 30 can be enhanced.

As described above, in the connector of the above embodiment, the withdrawal of the front holder 20 is prevented directly by the lances 12. Therefore, retaining means for preventing the withdrawal of the front holder 20 does not need to be provided at other portion of the housing 10 than the lances, and this contributes to the compact design of the connector 10.

Furthermore, in the connector of the above embodiment, the front holder 20 assists the lances 12 in retaining the respective metal terminals 30 against withdrawal, and therefore the force for retaining the metal terminals 30 can be increased.

Furthermore, in the connector of the above embodiment, the front holder 20, when attached to the connector housing 10, presses and displaces the lances 12 in such a direction as to more firmly engage the lances 12 with the respective metal terminals 30, and therefore the force for retaining the metal terminals 30 can be further increased. Furthermore, in the connector of the above embodiment, the dimension of the clearance 32 between each metal terminal 30 and the lance 12 can be reduced, and therefore the shaking or movement of the metal terminal 30 can be reduced.

The present invention is not limited to the above embodiment, and suitable modifications, improvement, etc., can be made. Also, the material, form, number, disposition, etc., of each of the constituent elements of the above embodiment are arbitrary and are not limited in so far as the invention can be achieved.

What is claimed is:

1. A connector, comprising:

a connector housing; and a front holder attached to said connector housing from a front side thereof;

said connector housing including:

a terminal receiving chamber into which a metal terminal can be inserted from a rear side thereof;

an elastic lance for retaining said metal terminal, inserted into said terminal receiving chamber from the rear side, to prevent rearward withdrawal of said metal terminal;

an elastic deformation space for said lance; and a front holder insertion space which is provided at a front side of said elastic deformation space in continuous relation thereto such that said front holder can be inserted into a predetermined position in said front holder insertion space from the front side of said connector housing; and said front holder including:

a lance holding portion which enters said elastic deformation space to prevent elastic deformation of said lance when said front holder is mounted into said front holder insertion space of said connector housing from the front side thereof; and wherein an engagement portion is provided between said lance and said lance holding portion, and when said lance and said lance holding portion are engaged with each other, said engagement portion prevents forward movement of said front holder, and transmits a rearward force which is applied from said metal terminal to said lance, to said front holder.

2. A connector according to claim 1, wherein when said lance and said lance holding portion are engaged with each other, said engagement portion provided between said lance and said lance holding portion presses and displaces said lance in a direction to more firmly engage said lance with said metal terminal.

* * * * *